US011059070B2

(12) United States Patent
Burock

(10) Patent No.: US 11,059,070 B2
(45) Date of Patent: Jul. 13, 2021

(54) DEVICE AND METHOD FOR DYNAMIC METERING OF SEALING COMPOUNDS

(71) Applicant: CHEMETALL GMBH, Frankfurt (DE)

(72) Inventor: Heinz Burock, Frankfurt am Main (DE)

(73) Assignee: CHEMETALL GMBH, Frankfurt (DE)

( * ) Notice: Subject to any disclaimer, the term of this patent is extended or adjusted under 35 U.S.C. 154(b) by 147 days.

(21) Appl. No.: 16/332,919

(22) PCT Filed: Sep. 5, 2017

(86) PCT No.: PCT/EP2017/072215
§ 371 (c)(1),
(2) Date: Mar. 13, 2019

(87) PCT Pub. No.: WO2018/050482
PCT Pub. Date: Mar. 22, 2018

(65) Prior Publication Data

US 2019/0232330 A1 Aug. 1, 2019

(30) Foreign Application Priority Data

Sep. 13, 2016 (DE) ..... 102016217429.0
Dec. 12, 2016 (DE) ..... 102016224655.0

(51) Int. Cl.
*B05C 11/10* (2006.01)
*B05C 9/06* (2006.01)
(Continued)

(52) U.S. Cl.
CPC ..... *B05C 11/1036* (2013.01); *B01F 15/0251* (2013.01); *B01F 15/042* (2013.01);
(Continued)

(58) Field of Classification Search
CPC . B05C 11/10; B05C 11/1036; B05C 11/1002; B05C 11/1047; B05C 11/1039;
(Continued)

(56) References Cited

U.S. PATENT DOCUMENTS 3,224,411 A * 12/1965 Blaha ..... B05C 5/0291 118/408
3,390,814 A * 7/1968 Creighton, Jr. ... B05C 17/00566 222/137

(Continued)

FOREIGN PATENT DOCUMENTS

| | | |
|---|---|---|
| EP | 1000669 A1 | 5/2000 |
| EP | 2191904 A2 | 6/2010 |
| WO | 2018019848 A1 | 2/2018 |

OTHER PUBLICATIONS

International Search Report for International Application No. PCT/EP2017/072215, dated Aug. 12, 2017, 2 pages.

*Primary Examiner* — Frederick C Nicolas
*Assistant Examiner* — Randall A Gruby
(74) *Attorney, Agent, or Firm* — Armstrong Teasdale LLP

(57) ABSTRACT

Described herein is an apparatus for dynamic metering of sealant volumes, and also described herein is a corresponding method.

Figure 1:
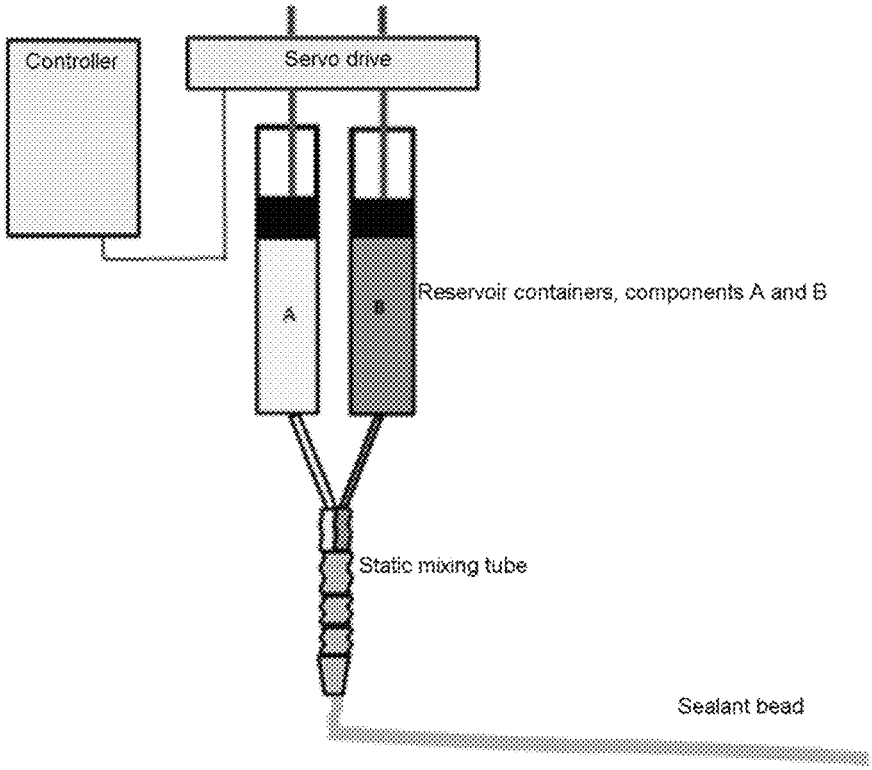

The apparatus of the invention includes two containers for sealant components; a first drive, which is connected to two devices, each of which is able to convey one of the sealant components from its container; a drive controller; a mixing unit for mixing the sealant components conveyed from the containers, having an opening for applying the sealant to a component; and also, additionally, a compensating container with a compensating volume; and a second drive, which is connected to a piston which reaches into the compensating volume of the compensating container.

The compensating container in this arrangement is connected to the mixing unit. The first drive and the second drive can be dynamically controlled jointly by the drive controller.

14 Claims, 2 Drawing Sheets

(51) Int. Cl.
*B05C 9/08* (2006.01)
*B01F 15/02* (2006.01)
*B01F 15/04* (2006.01)
*B05C 5/02* (2006.01)

(52) U.S. Cl.
CPC ..... *B01F 15/0479* (2013.01); *B05C 9/06* (2013.01); *B05C 9/08* (2013.01); *B05C 11/1002* (2013.01); *B05C 11/1039* (2013.01); *B05C 11/1047* (2013.01); *B05C 5/02* (2013.01); *B05C 5/0225* (2013.01)

(58) Field of Classification Search
CPC . B05C 5/0225; B05C 9/06; B05C 9/08; B01F 15/0251; B01F 15/042; B01F 15/0479
USPC ..... 222/129–136, 145.5, 145.6, 280, 281
See application file for complete search history.

(56) References Cited

U.S. PATENT DOCUMENTS 3,401,847 A * 9/1968 Downing ..... B05C 17/0123 222/327
3,989,228 A * 11/1976 Morris ..... B29B 7/7447 366/159.1
4,067,479 A * 1/1978 Moline ..... B01F 7/086 222/94
4,666,430 A * 5/1987 Brown ..... A61M 5/14526 128/DIG. 12
4,957,572 A * 9/1990 Dewitte ..... E06B 3/6733 156/109
4,995,540 A * 2/1991 Colin ..... A61C 9/0026 222/132
5,064,098 A * 11/1991 Hutter, III ..... B05C 17/0113 222/137
5,080,493 A * 1/1992 McKown ..... B01F 5/0615 222/136
5,224,629 A * 7/1993 Hsieh ..... B05C 17/00513 222/137
5,478,150 A 12/1995 Keller et al.
5,816,445 A * 10/1998 Gardos ..... B01F 15/0454 222/1
5,979,794 A * 11/1999 DeFillipi ..... B01F 15/0462 239/135
6,126,401 A * 10/2000 Latham ..... F15B 7/005 417/16
6,234,355 B1 * 5/2001 Lenhardt ..... B01F 15/0203 222/135
6,260,577 B1 * 7/2001 Keller ..... B05C 11/10 137/265
6,543,580 B1 * 4/2003 Gathmann ..... B01F 5/0618 118/420
6,726,773 B1 * 4/2004 Yanagita ..... B05B 9/047 118/323
6,736,291 B1 * 5/2004 Mimura ..... B05C 11/1047 222/129
6,896,152 B2 * 5/2005 Pittman ..... B01F 13/1055 222/135
8,197,122 B2 * 6/2012 Reinprecht ..... B29B 7/7442 366/279
2003/0080152 A1 * 5/2003 Balcome ..... B05C 17/0103 222/136
2006/0278658 A1 * 12/2006 Nisbet ..... B01F 15/0466 222/137
2007/0000947 A1 * 1/2007 Lewis ..... B01F 13/1055 222/132
2009/0140007 A1 * 6/2009 Voss ..... B01F 15/0201 222/135
2011/0253747 A1 10/2011 Tobler et al.

* cited by examiner

DEVICE AND METHOD FOR DYNAMIC METERING OF SEALING COMPOUNDS

CROSS-REFERENCE TO RELATED APPLICATIONS

This application is a U.S. National Phase Application of PCT/EP2017/072215, filed Sep. 5, 2017, which claims the benefit of priority to German Patent Application Nos. 102016217429.0, filed Sep. 13, 2016, and 102016224655.0, filed Dec. 12, 2016, the entire contents of which are hereby incorporated by reference herein.

FIELD OF INVENTION

The present invention relates to an apparatus for dynamic metering of sealant volumes, and also to a corresponding method.

BACKGROUND

Sealants of the kind employed, for example, in aircraft and space vehicles are generally produced by the mixing of two components—base compound and curative—in a mixing apparatus, and are subsequently cured in situ, i.e., on the component to be coated. The curing operation may be accomplished thermally and/or by actinic radiation.

One apparatus for this purpose is shown in FIG. 1: Components A and B are initially located in separate reservoir containers. A suitable drive, preferably a servo drive, is actuated such that the two components (A and B) are conveyed at a defined rate into a static mixing tube and are mixed with one another. The sealant thus obtained, which as yet is not fully cured, then exits the apparatus in the form of a bead.

When carrying out sealing on components whose geometry is complicated, the metering rate—that is, the volume of sealant that is applied per unit of time—has to be adjusted dynamically, in other words in accordance with the particular site being sealed. The term "dynamic metering" is also used.

With the latter form of metering, however, a problem which arises is that, when using static mixers, the metering rate cannot be lowered ad infinitum without adversely affecting the mixing ratio and the quality of mixing.

The primary reason for this is that the base compound component—a polysulfide-based component, for example—is compressible, whereas the curative component lacks compressibility, so leading, as the metering rate goes down, to the increasingly retarded release of the base compound component from its reservoir container, in comparison to the curative component.

Especially when metering rates are extremely low, as in the case of spot metering operations, therefore, problems arise with regard to an altered mixing ratio and also a reduced quality of mixing.

If the traveling velocity of a cross-member bearing the above-described apparatus is increased in order to achieve a lower discharge per unit distance—in other words, an ostensibly lower metering rate—this is nevertheless accomplished, in the case of complicated geometries, at the expense of metering accuracy.

DESCRIPTION

It was an object of the present invention, therefore, to provide an apparatus for dynamic metering of sealants, and also a corresponding method, with which mixing of sufficient quality and also metering of sufficient accuracy are achieved independently of the metering rate, in other words even at low metering rates.

This object has been achieved by an apparatus according to claim 1 and by a method according to claim 10. Preferred embodiments are described respectively in the dependent claims.

The apparatus of the invention for dynamic metering of sealants comprises two containers for sealant components; a first drive, which is connected to two devices, each of which is able to convey one of the sealant components from its container (conveying devices); a drive controller; a mixing unit for mixing the sealant components conveyed from the containers, having an opening for applying the sealant to a component; and also, additionally, a compensating container with a compensating volume; and a second drive, which is connected to a piston which reaches into the compensating volume of the compensating container.

The compensating container in this arrangement is connected to the mixing unit. The compensating container is filled and emptied through this connection. The first drive and the second drive can be dynamically controlled jointly by the drive controller.

Figure 2:
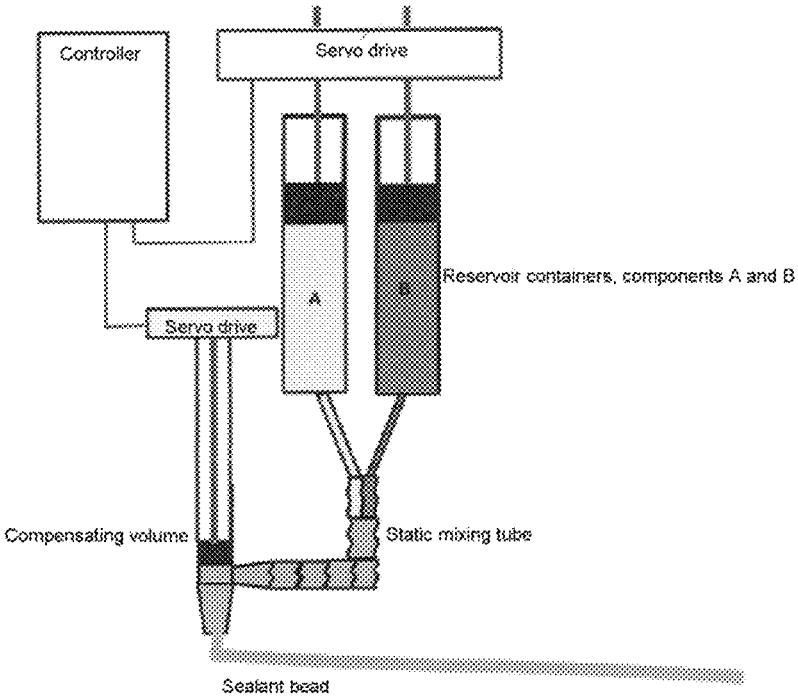
Figure 3:
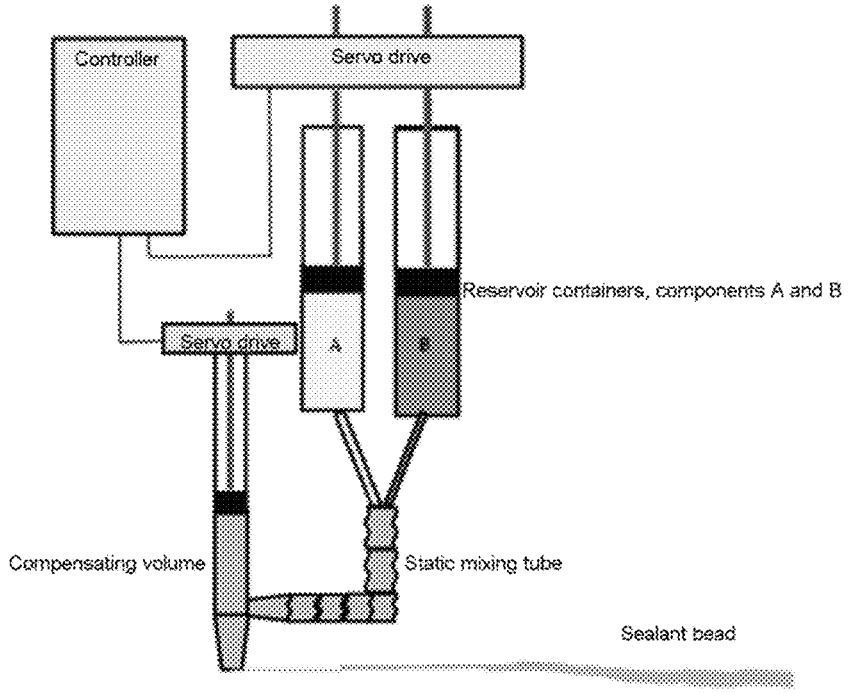
Figure 4:
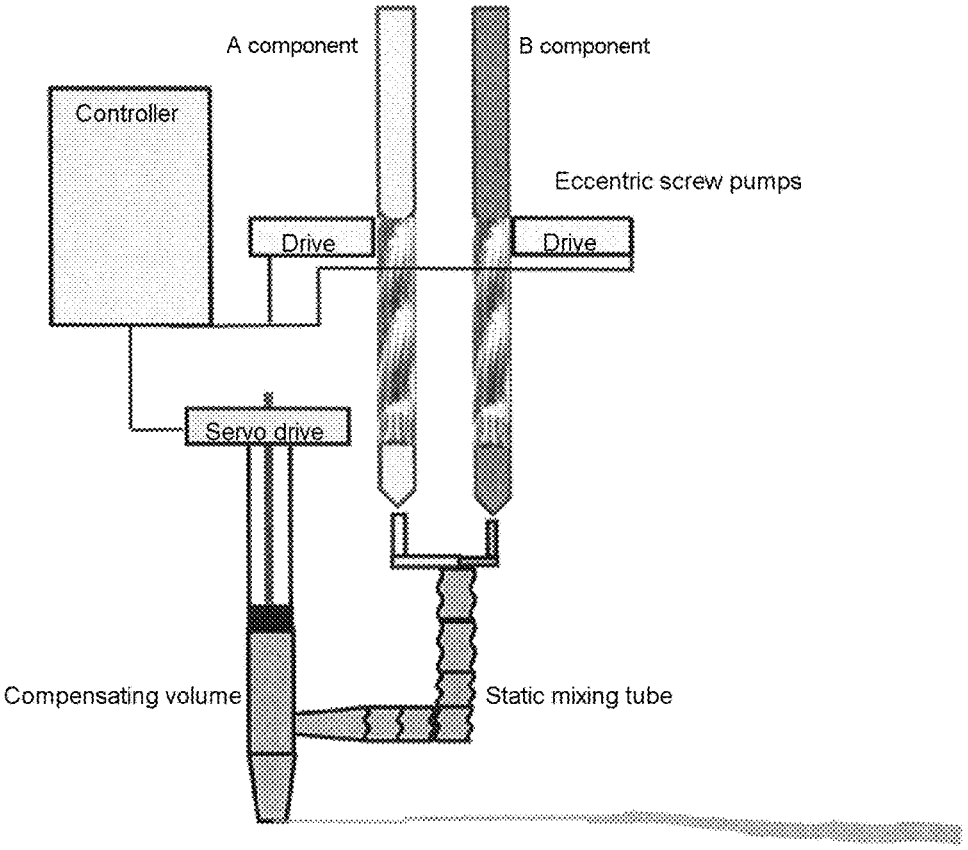

A first such apparatus of the invention is shown in FIG. 2 and also in FIG. 3, and a second in FIG. 4; these figures, however, should not be understood as imposing any limitation.

By a "sealant" is presently always meant the mixture of two sealant components.

The "first drive" may also consist of two drive units, to be controlled separately, of which the first is connected to the first and the second to the second of the two conveying devices (cf. FIG. 4). According to one preferred embodiment, however, the first drive consists of a single drive unit, which is connected to the two conveying devices.

On the one hand, the "two containers for sealant components" may be reservoir containers, i.e., containers which can each be filled with a defined amount of sealant component and then closed (cf. FIG. 2 and FIG. 3).

On the other hand, the "two containers for sealant components" may be open containers, i.e., containers which can each be filled continuously with a sealant component (cf. FIG. 4). In this way, an uninterrupted flow of sealant can be achieved (cf. FIG. 4).

The "mixing unit" may be a static mixer, a dynamic mixer, or a combination of both.

Preferably the first and/or second drive is a servo drive, and more preferably the first and the second drive is in each case a servo drive.

According to one first preferred embodiment, the two conveying devices are pistons, of which one each reaches into one of the containers, which in this case are reservoir containers, and is able to push out the corresponding sealant component.

According to one second preferred embodiment, the two conveying devices are pumps, which by generating a reduced pressure are able to draw the sealant components from their containers. Suitable for this purpose in particular are eccentric screw pumps and also scoop piston pumps.

In the case of eccentric screw pumps, in particular, said containers are open containers, which can each be filled continuously with a sealant component (cf. FIG. 4).

The mixing unit is preferably a static mixer, more particularly a static mixing tube.

The compensating container is preferably a cartridge of plastic or a component that is easy to clean, and more preferably is a cartridge of plastic, more particularly one made of polyethylene (PE).

According to a first particularly preferred embodiment, the apparatus is a 2-component mixing and metering system of the kind produced, for example, by Hilger u. Kern (Mannheim, Germany). These systems allow the conveying, mixing, and metering of sealant consisting of 2 components from reservoir containers (cf. FIG. 2 and FIG. 3).

The sealant may also be a sealant of the kind which cures substantially only after irradiation with actinic radiation, more particularly with UV radiation. An advantage of a sealant of this kind is that its curing can be initiated in a controlled way with a trigger (SCOD: sealant curing on demand). The apparatus of the invention may for this purpose comprise an integrated source of actinic radiation, more particularly of UV radiation.

In the case of the method of the invention for dynamic metering of sealants, the containers of the apparatus of the invention are each filled with one sealant component (components A and B, or base compound and curative). The sealant components are then mixed in a mixing unit and the resultant sealant is applied to a component, by conveying the sealant components from the containers by means of the first drive.

In this procedure, a metering rate below a critical value preset in the drive controller is actualized by lowering the conveying rate of the sealant components from the containers to the critical value of the metering rate, and filling the compensating container with sealant by means of the second drive in such a way that the rate at which the compensating container is filled corresponds to the difference between the critical value and the actualized value of the metering rate.

If, for example, the critical value of the metering rate is 3 volume units of sealant/unit of time, then a metering rate of, for example, 1 volume unit of sealant/unit of time is actualized by lowering the conveying rate of the sealant components from the containers to 3 volume units of sealant/unit of time, and filling the compensating container at a rate of 2 volume units of sealant/unit of time.

FIG. 2 shows the apparatus of the invention in the case of a metering rate above the critical value. In FIG. 3, in contrast, the metering rate is lower than the critical value, as indicated by a reduction in the thickness of the sealant bead. The compensating volume of the compensating container is in this case filled with sealant.

In the event of the metering rate climbing again to at least the critical value, the conveying of the sealant components from the containers is halted, and the sealant is conveyed from the compensating container by means of the second drive, preferably until the sealant in the compensating container is used up. This makes a contribution to keeping the compensating container empty enough in order to allow it to be filled again with sealant at a later point in time.

Alternatively, however, the conveying of the sealant components from the containers may continue to take place by means of the first drive, and at the same time the sealant may be conveyed from the compensating container by means of the second drive, until the sealant in the compensating container is used up. By this means, it is possible to increase the metering rate beyond the maximum value which would be possible with the apparatus without the compensating container.

The present invention relates, moreover, to a component which has been sealed by means of the method of the invention, preferably a component with complicated geometry, as employed in aircraft and space vehicles.

The invention claimed is:

1. An apparatus for dynamic metering of sealants, comprising two sealant components held in two respective containers, a first drive which is connected to two devices, each of which is able to convey one of the sealant components from the respective container, a drive controller, a mixing unit for mixing the sealant components conveyed from the containers, having an opening for applying a resultant sealant to a component, wherein the apparatus additionally comprises a compensating container with a compensating volume, and a second drive, which is connected to a piston which reaches into the compensating volume of the compensating container, wherein the compensating container is connected to the mixing unit and wherein the first drive and second drive can be dynamically controlled jointly by the drive controller.

2. The apparatus according to claim 1, wherein the first and/or the second drive is in each case a servo drive.

3. The apparatus according to claim 1, wherein the two conveying devices are pistons, each one of which reaches into one of the containers for sealant components, and wherein at least one of the containers is a reservoir container.

4. The apparatus according to claim 1, wherein the two conveying devices are pumps.

5. The apparatus according to claim 4, wherein the two conveying devices are eccentric screw pumps and the containers for sealant components are open containers which can each be filled continuously with a sealant component.

6. The apparatus according to claim 1, wherein the mixing unit is a static mixer.

7. The apparatus according to claim 1, wherein the compensating container is a cartridge of plastic or a component that is easy to clean.

8. The apparatus according to claim 1, wherein the apparatus is a 2-component mixing and metering system.

9. The apparatus according to claim 1, wherein it comprises an integrated source of actinic radiation.

10. A method for dynamic metering of sealants, wherein the containers of the apparatus according to claim 1 are each filled with one sealant component, wherein the sealant components are mixed in the mixing unit, and wherein the resultant sealant is applied to a surface, by conveying the sealant components from the containers through use of the first drive, wherein a metering rate below a critical value preset in the drive controller is actualized by lowering a conveying rate of the sealant components from the containers to the critical value, and filling the compensating container with the resultant sealant through use of the second drive in such a way that the rate at which the compensating container is filled corresponds to a difference between the critical value and the metering rate.

11. The method according to claim 10, wherein, in an event of the metering rate climbing again to at least the critical value, the conveying of the sealant components from the containers is halted, and the sealant is conveyed from the compensating container through use of the second drive, until the sealant in the compensating container is used up.

12. The method according to claim 10, wherein, in the event of the metering rate climbing again to at least the critical value, the conveying of the sealant components from the containers through use of the first drive and of the sealant from the compensating container through use of the second drive takes place simultaneously until the sealant in the compensating container is used up.

13. The method according to claim 10, wherein the sealant is a sealant which cures substantially only after irradiation with actinic radiation.

14. The apparatus according to claim 1, wherein the two conveying devices are eccentric screw pumps or scoop piston pumps.

* * * * *